US010428580B2

(12) United States Patent
Vries et al.

(10) Patent No.: US 10,428,580 B2
(45) **Date of Patent: *Oct. 1, 2019**

(54) SPRING OPERATED ROLLER BLIND SYSTEM WITH TENSION SPRING ADJUSTING MECHANISM AND LOCKING ELEMENT FOR SAID SYSTEM

(71) Applicant: Coulisse B.V., Enter (NL)

(72) Inventors: Ruben Hubert Jan de Vries, Zevenaar (NL); Bastiaan Franciscus Klein Tuente, Groenlo (NL); Thomas Johan Maria Ter Haar, Hengelo (NL)

(73) Assignee: Coulisse B.V., Enter (NL)

( * ) Notice: Subject to any disclaimer, the term of this patent is extended or adjusted under 35 U.S.C. 154(b) by 26 days.

This patent is subject to a terminal disclaimer.

(21) Appl. No.: 15/336,275

(22) Filed: Oct. 27, 2016

(65) Prior Publication Data

US 2017/0159359 A1 Jun. 8, 2017

(30) Foreign Application Priority Data

Oct. 29, 2015 (NL) ..... 2015678
Jun. 7, 2016 (NL) ..... 2016908

(51) Int. Cl.
*E06B 9/42* (2006.01)
*E06B 9/60* (2006.01)
(Continued)

(52) U.S. Cl.
CPC ..... *E06B 9/60* (2013.01); *E06B 9/42* (2013.01); *E06B 9/44* (2013.01); *E06B 9/50* (2013.01)

(58) Field of Classification Search
CPC ..... E06B 9/60; E06B 9/42; E06B 9/44; E06B 9/50; E06B 9/08; E06B 9/17; E06B 9/171;
(Continued)

(56) References Cited

U.S. PATENT DOCUMENTS 4,228,843 A * 10/1980 Kobayashi ..... E06B 9/60 160/306
7,325,584 B2 * 2/2008 Bousson ..... E06B 9/60 160/191
(Continued)

FOREIGN PATENT DOCUMENTS

CN 203867436 U 10/2014
EP 2933428 A1 * 10/2015
(Continued)

OTHER PUBLICATIONS

Dutch Search Report in NL2015678, dated Aug. 18, 2016.

*Primary Examiner* — Daniel P Cahn
(74) *Attorney, Agent, or Firm* — Oppedahl Patent Law Firm LLC

(57) ABSTRACT

A roller blind system, comprising a roller blind having a roller shaft through which a central rod extends and to which a flexible sheet member is attached. The roller blind is provided with two bracket connectors arranged for releasable coupling to mounting brackets. The roller blind is spring operated and comprises a tension spring fixedly connected to the central rod and to the roller shaft and a tension adjusting mechanism for adjusting the tension of the tension spring. The tension adjusting mechanism comprises an adjusting wheel and an adjusting spring for adjusting the rotational position of the central rod, a first bush part arranged on the adjusting wheel for pushing the adjusting spring in a relaxed configuration and a second bush part connected to the central rod for pushing the adjusting spring in a tightened configuration.

12 Claims, 10 Drawing Sheets

(51) Int. Cl.
*E06B 9/50* (2006.01)
*E06B 9/44* (2006.01)

(58) Field of Classification Search
CPC ..... E06B 2009/1716; E06B 9/34; E06B 9/40; E06B 9/56; E06B 2009/587; E06B 2009/6809; E06B 9/80; E06B 9/172; E06B 9/173; A47H 1/142
USPC ..... 160/315
See application file for complete search history.

(56) References Cited

U.S. PATENT DOCUMENTS 7,694,712 B2 * 4/2010 Schimko ..... B60J 1/2027 160/314
8,302,655 B2 * 11/2012 Lin ..... F03G 1/00 160/313
9,452,663 B2 * 9/2016 Watanabe ..... B60J 1/2038
9,631,425 B2 * 4/2017 Campagna ..... E06B 9/60
9,951,555 B2 * 4/2018 Klein Tuente ..... A47H 1/142
9,963,935 B2 * 5/2018 Faller ..... E06B 9/80
2005/0150615 A1 * 7/2005 Bousson ..... E06B 9/60 160/313
2009/0256036 A1 * 10/2009 Wilson ..... E06B 9/323 248/201
2010/0122780 A1 * 5/2010 Cheng ..... E06B 9/42 160/305
2012/0048484 A1 * 3/2012 Munsters ..... B60J 1/2063 160/313
2012/0132376 A1 5/2012 Cannaverde
2013/0153161 A1 * 6/2013 Haarer ..... E06B 9/42 160/293.1
2014/0000819 A1 * 1/2014 Mullet ..... E06B 9/60 160/311
2014/0014281 A1 * 1/2014 Mullet ..... E06B 9/42 160/311
2015/0136337 A1 * 5/2015 Fraczek ..... F16D 67/02 160/291
2015/0191973 A1 * 7/2015 Bohlen ..... E06B 9/80 160/291
2015/0300085 A1 * 10/2015 Klein Tuente ..... A47H 1/142 248/267
2016/0010390 A1 * 1/2016 Smith ..... E06B 9/60 160/302
2016/0245018 A1 * 8/2016 Pohjonen ..... E06B 9/80
2017/0159359 A1 * 6/2017 Vries ..... E06B 9/60
2017/0268293 A1 * 9/2017 de Vries ..... E06B 9/72
2018/0106106 A1 * 4/2018 de Vries ..... E06B 9/78

FOREIGN PATENT DOCUMENTS

GB 2405661 A 3/2005
WO 2013/129915 A1 9/2013

* cited by examiner

SPRING OPERATED ROLLER BLIND SYSTEM WITH TENSION SPRING ADJUSTING MECHANISM AND LOCKING ELEMENT FOR SAID SYSTEM

The present invention relates to a roller blind system, comprising a roller blind provided with a roller shaft through which roller shaft a central rod extends and a flexible sheet member, such as a roller blind fabric or a screen, is attached, wherein the roller blind is further provided with two bracket connectors attached at the outer ends of the central rod, wherein the bracket connectors are arranged for releasable coupling to mounting brackets for mounting the roller blind system on a surface.

A roller blind system according to the invention is known from European patent application EP2933428 of the same applicant. Herein the roller blind is chain operated. The inventive bracket connectors of the known roller blind system are easy to couple to the inventive mounting brackets in any situation.

The invention has for its object to provide a spring operated roller blind system that allows for easy releasable coupling of a spring operated roller blind to mounting brackets.

The roller blind system according to the invention is characterized in that the roller blind is spring operated and comprises a tension spring fixedly connected to the central rod and to the roller shaft and a tension adjusting mechanism for adjusting the tension of the tension spring, wherein the tension adjusting mechanism comprises an adjusting wheel and an adjusting spring for adjusting the rotational position of the central rod, wherein the tension adjusting mechanism further comprises first engaging means for pushing the adjusting spring in a relaxed configuration and second engaging means for pushing the adjusting spring in a tightened configuration, wherein the first engaging means are arranged on the adjusting wheel and the second engaging means are connected to the central rod.

The roller blind system according to the invention allows for easy releasable mounting of a spring operated roller blind in mounting brackets. Advantageously the roller blind can be easily removed for replacement by the user. After mounting the roller blind the tension adjusting mechanism allows for optimal adjustment of the tension of the tension spring by the user to his or her specific needs. The roller blind system according to the invention does not require a mounting profile extending between the mounting brackets. Consequently the present invention provides a spring operated roller blind system that is suitable for the DIY market.

It is noted that a spring operated roller blind system comprising a tension spring fixedly connected to a central rod and a tension adjusting mechanism for adjusting the tension of the tension spring, wherein the tension adjusting mechanism comprises an adjusting wheel and the roller blind system comprises an adjusting spring is known per se from CN203867436. In the known roller blind system the adjusting wheel is integrated in one of the mounting bracket. An adjusting spring is part of a hydraulic speed reducing mechanism that is situated at the opposite outer end of the roller blind. The known roller blind system is not suitable for releasable coupling to mounting brackets.

According to a first preferred embodiment of the roller blind system according to the invention the adjusting wheel and the adjusting spring are arranged coaxially on the bracket connector. The tension adjusting mechanism in the first embodiment is consequently very compact thus avoiding the occurrence of any light gap between the flexible sheet member or roller curtain and the window frame.

In an elegant compact embodiment of the roller blind system according to the invention the first engaging means comprise a first bush part and the second engaging means comprise a second bush part and the adjusting spring is enclosed by the first bush part and the second bush part.

In a further preferred embodiment the tension adjusting mechanism further comprises an adjusting rod coupled as an extension to the central rod and wherein the second engaging means are arranged on the adjusting rod. The adjusting rod facilitates the connection to the central rod supporting achievement of the envisaged advantages.

According to a user friendly and embodiment of the roller blind system according to the invention the adjusting wheel is arranged for manual operation.

In another preferred embodiment the roller blind system according to the invention comprises a locking element for locking rotation of the bracket connector with respect to the central rod. Preferably the locking element is arranged for bridging the adjusting wheel and for locking onto the bracket connector on both sides of the adjusting wheel.

The locking element is especially useful prior to and during assembly of the roller blind system in the mounting brackets.

According to a practical embodiment the locking element comprises a lip, the adjusting wheel is provided with an opening for receiving the lip and the bracket connector is provided with a mating recess for receiving the lip. The locking means prevent rotation of the wheel with respect to the bracket connector. Once the roller blind is mounted in the mounting bracket, the lip can be easily removed by a user.

In a further preferred embodiment the locking element comprises a tongue to be received in a slot provided on the bracket connector. When the roller blind is mounted in a first type of mounting bracket, having a locking tooth to be received in said slot from the opposite side, the entire locking element is automatically pushed out. No action is required by the user.

In another preferred embodiment the locking element comprises a pair of shoulders adjacent to the tongue. When the roller blind is mounted in a second type of mounting bracket having guide teeth long enough to contact the shoulders before the bracket connector locks into the mounting bracket, the entire locking element is again automatically pushed out. Advantageously the locking element comprises an arc-shaped bridge part for bridging the adjusting wheel.

According to a complete embodiment the roller blind system according to the invention further comprises the mounting brackets for mounting the roller blind system on a surface.

The invention will now be described in more detail with reference to the figures, in which FIG. 1 shows a schematic view of a first preferred embodiment of a roller blind system according to the invention;

FIG. 2 shows a schematic view of the roller blind system of FIG. 1 with exploded parts;

FIG. 3 schematically shows part of FIG. 2 in exploded view;

Figure 6:
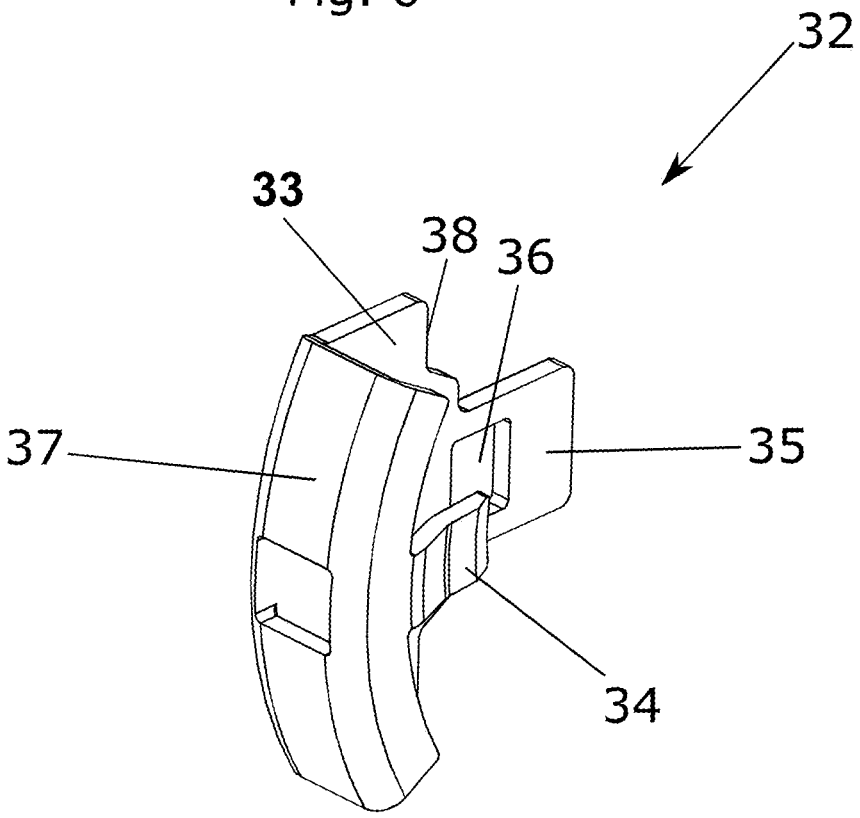
FIG. 6 shows a schematic view of a preferred embodiment of an alternative locking element for the roller blind system according to the invention.
Figure 7A:
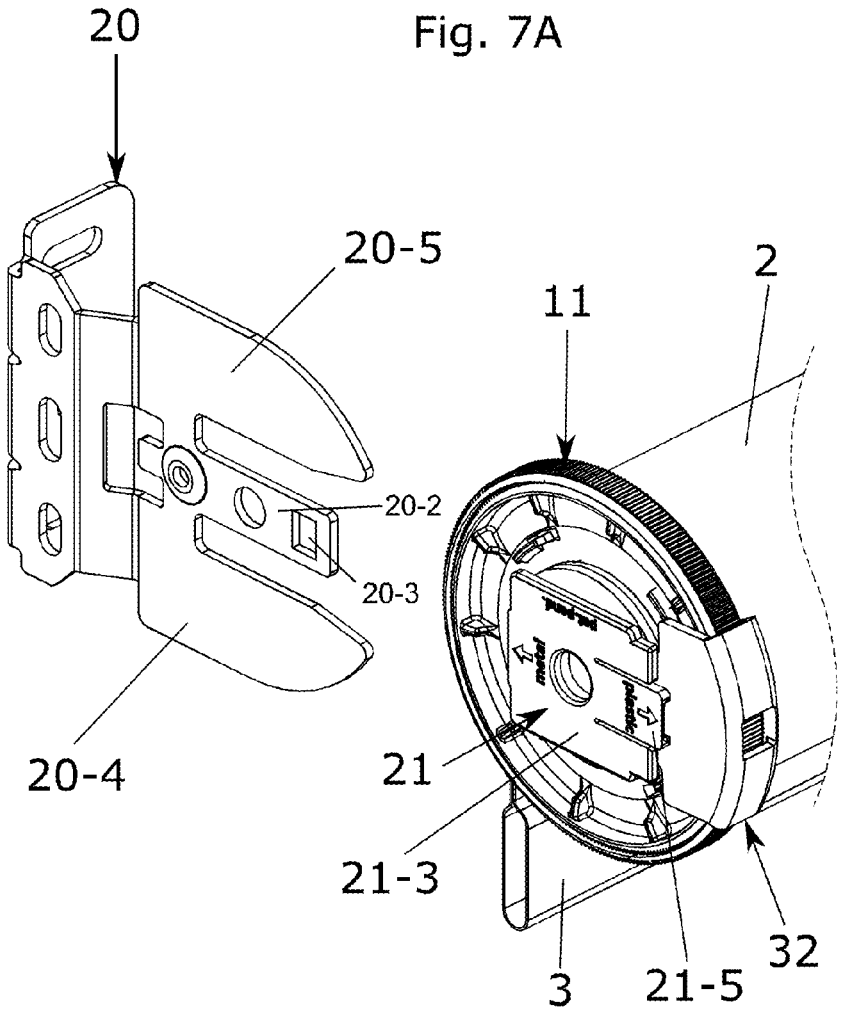
Figure 7B:
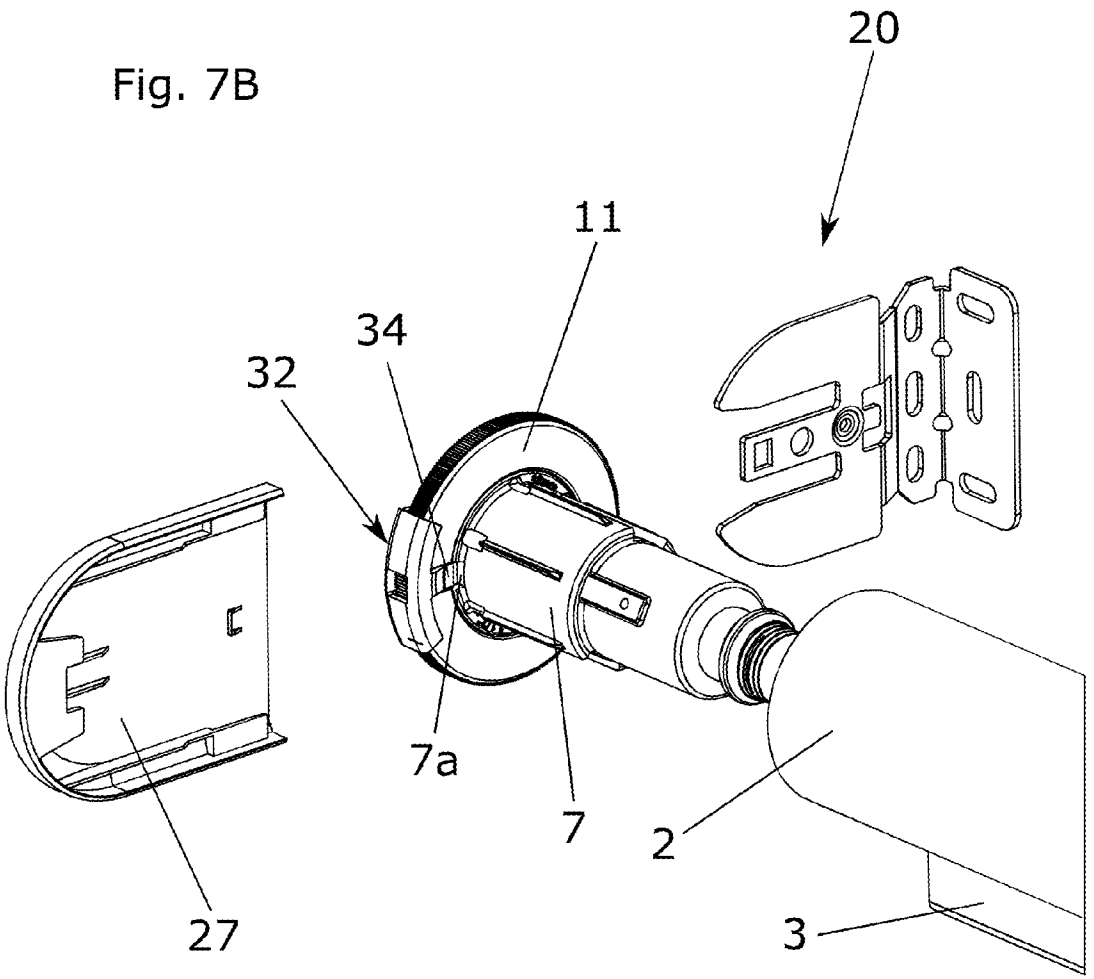
Figure 7C:
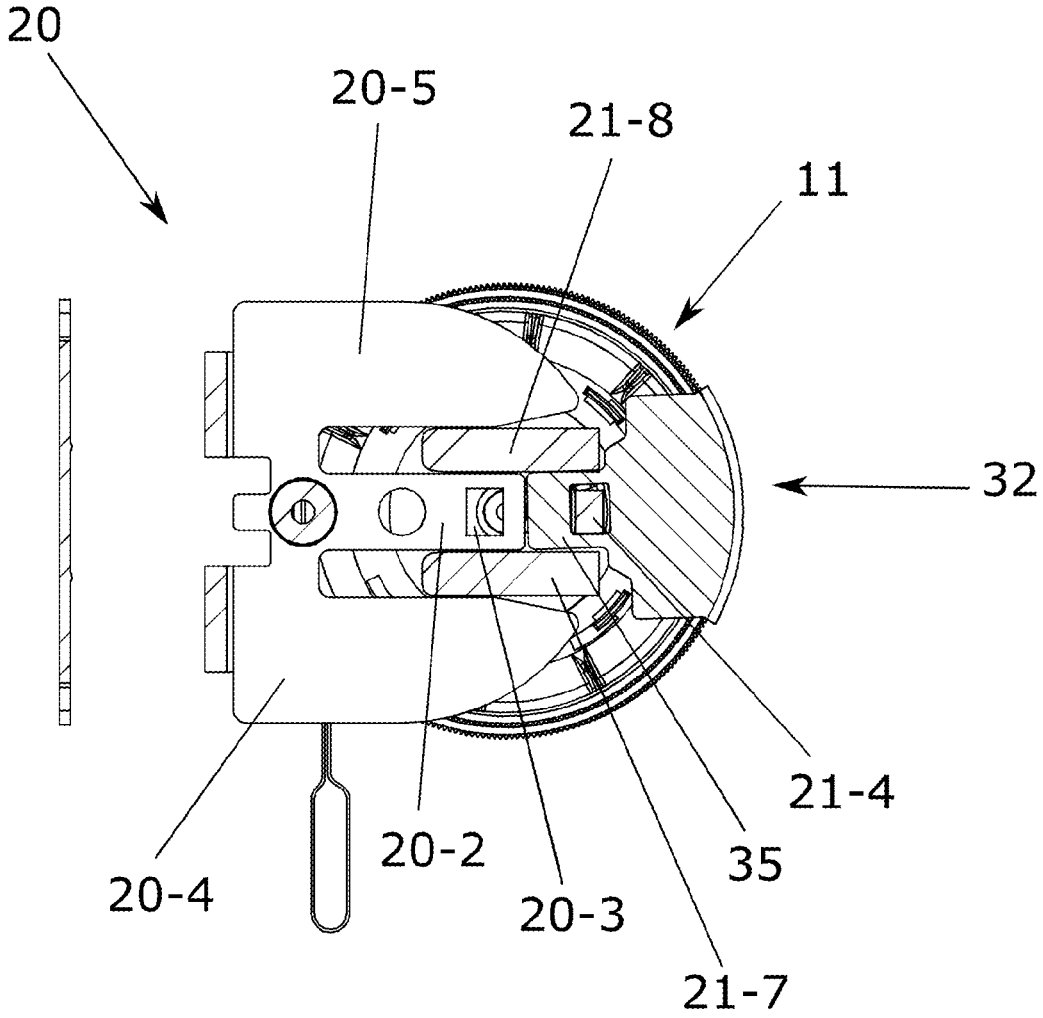
Figure 8:
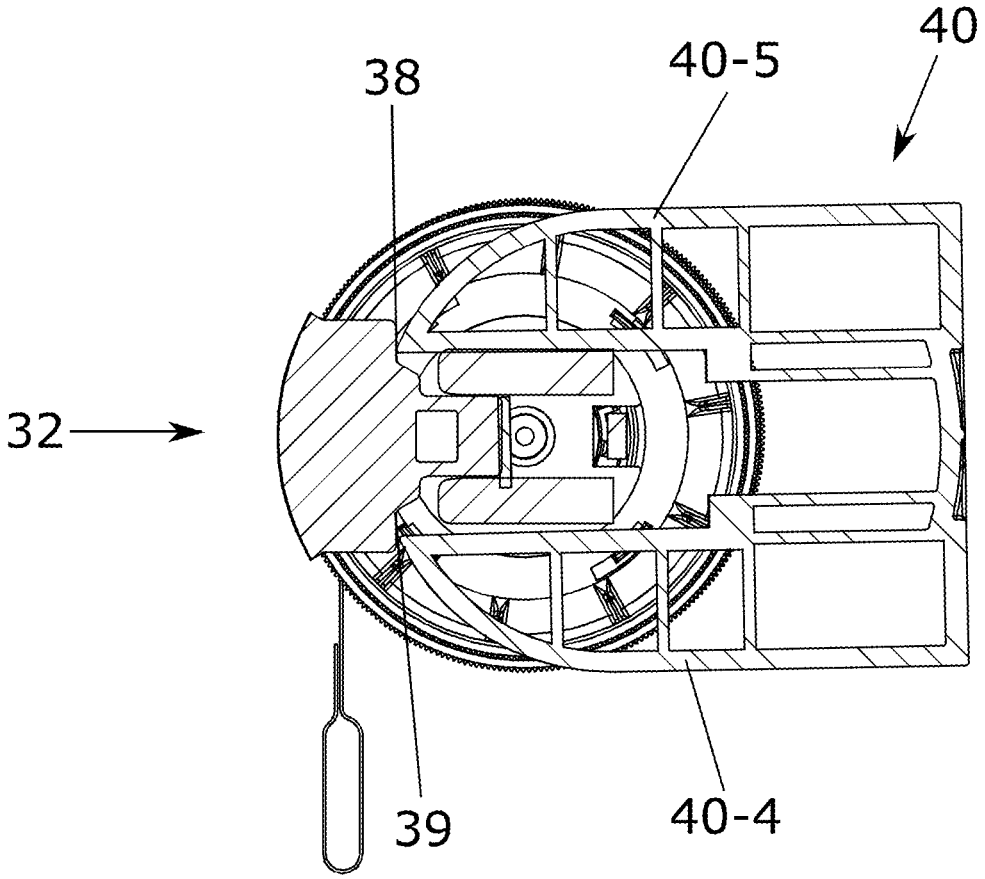

FIG. 7A schematically shows the locking element of FIG. 6 on roller blind system according to the invention from a first point of view;

FIG. 7B schematically shows the locking element of FIG. 6 on roller blind system according to the invention from a second point of view;

FIG. 7C illustrates unlocking of the locking element of FIG. 6 by a first type of mounting bracket; and FIG. 8 illustrates unlocking of the locking element of FIG. 6 by a second type of mounting bracket.

The same components are designated in the different figures with the same reference numerals.

Figure 1:
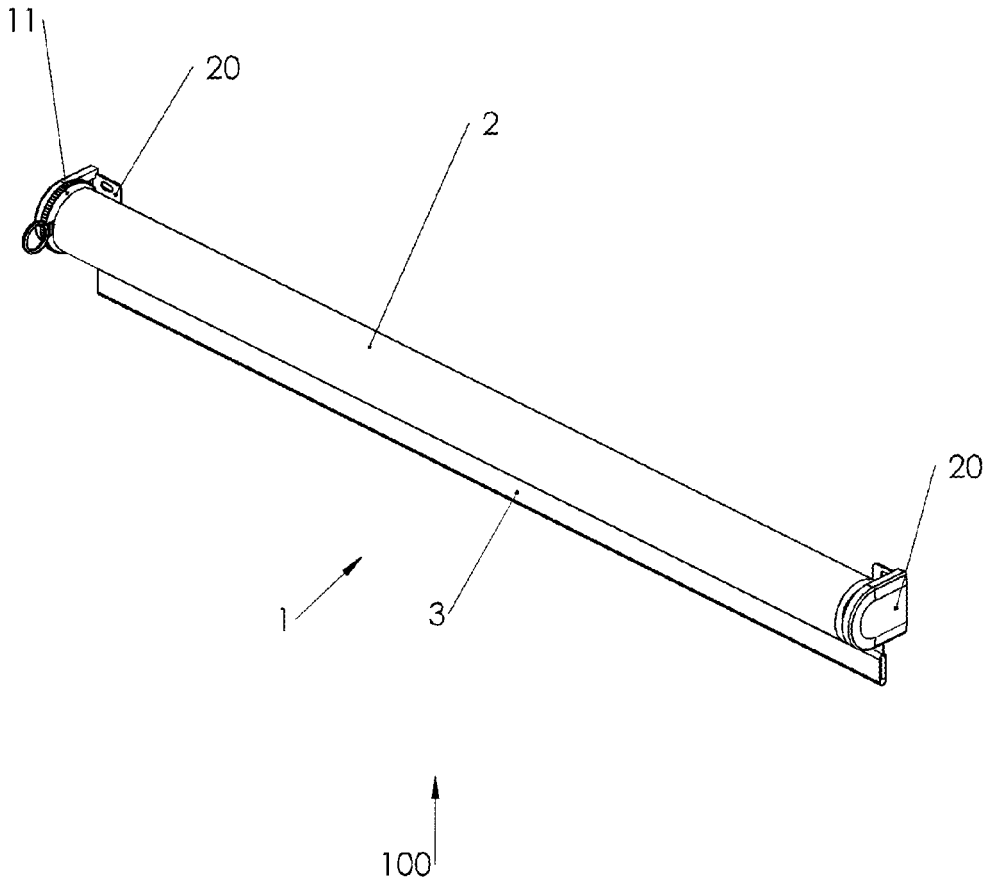
Figure 2:
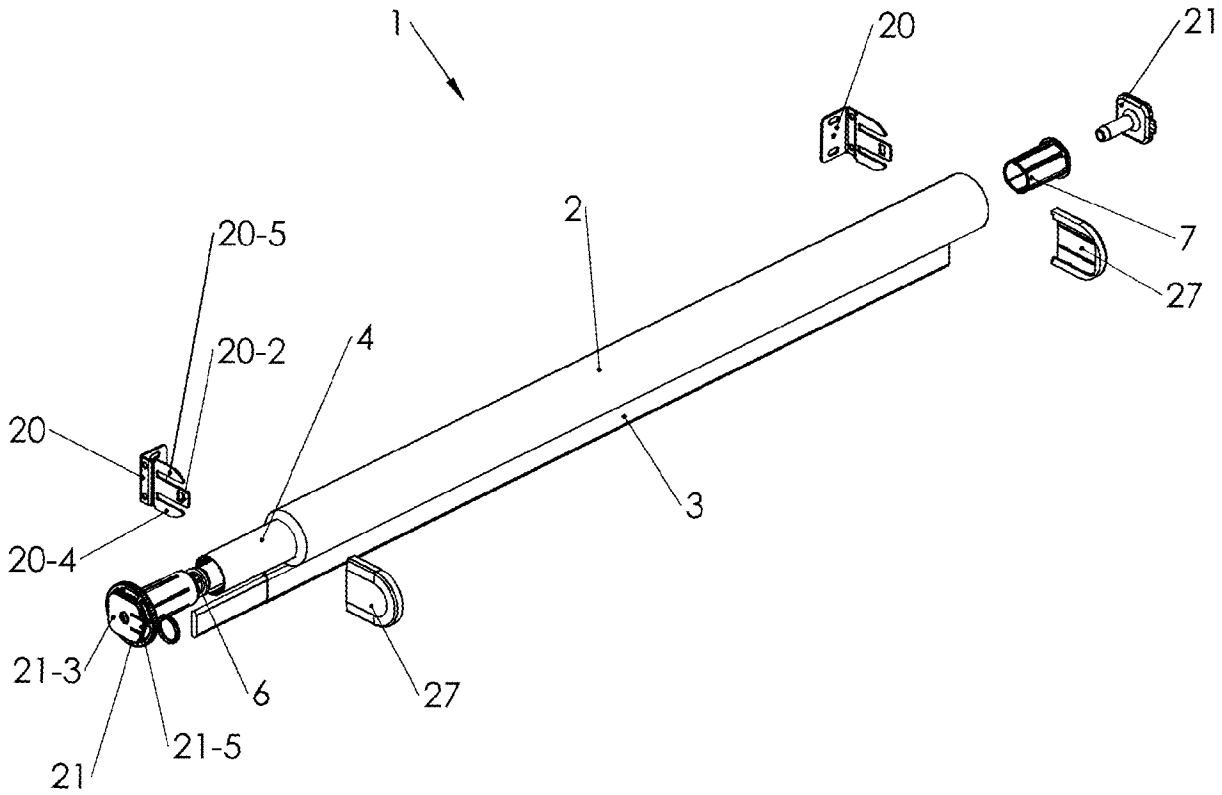
Figure 3:
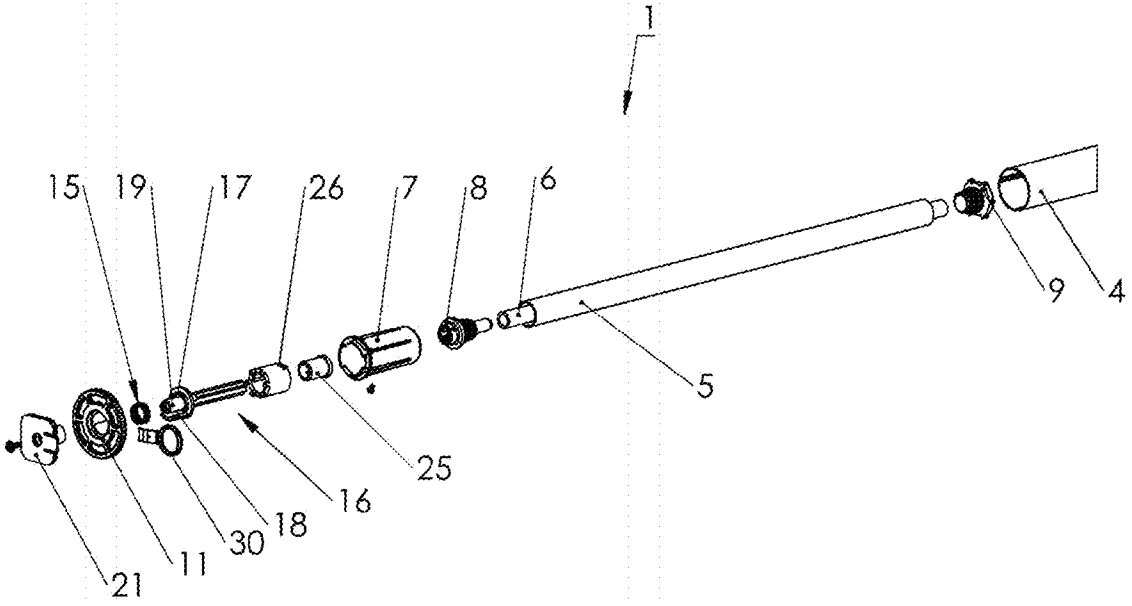
Figure 4:
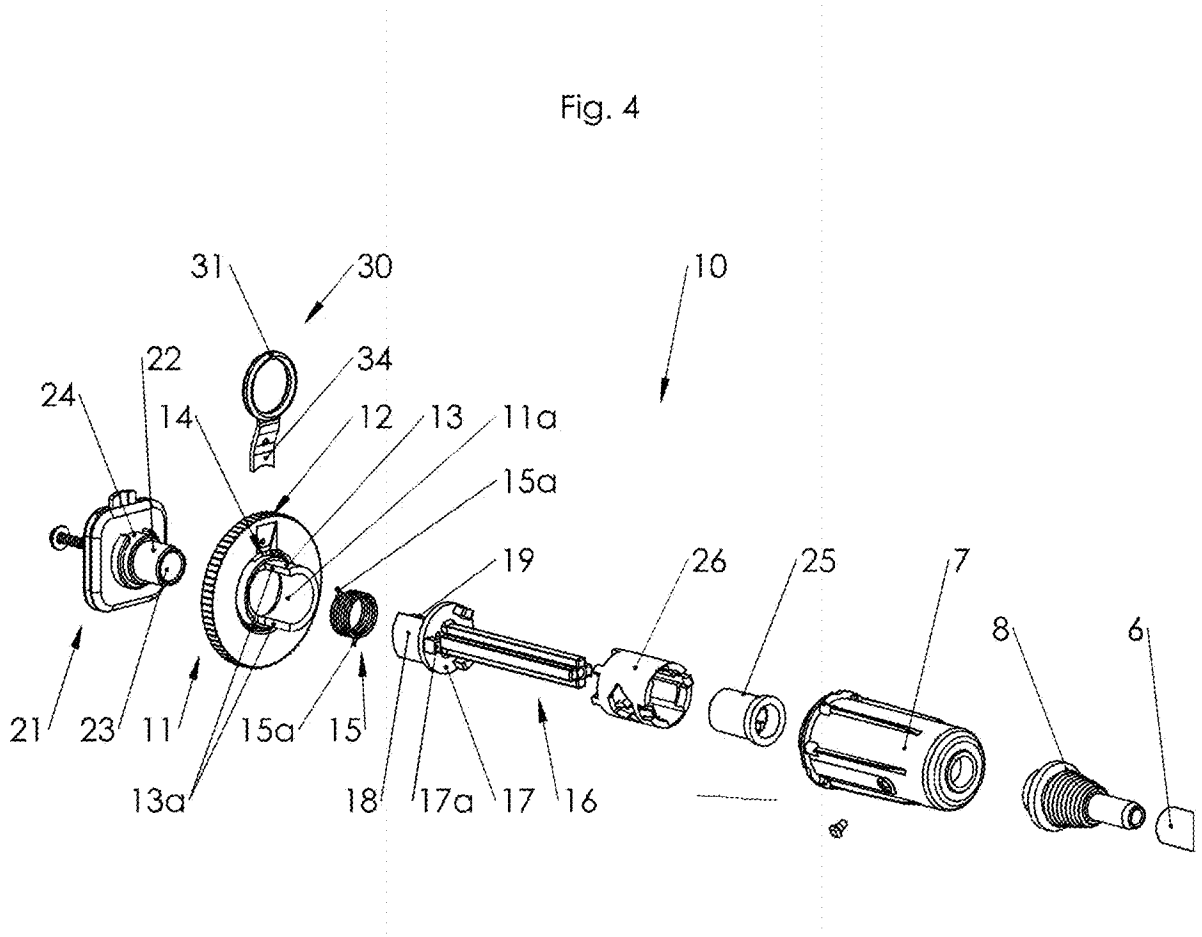
FIG. 4 is an enlarged view of part of FIG. 3.

FIG. 1 shows a schematic view of a first preferred embodiment of a roller blind system according to the invention. FIG. 2 shows the roller blind system of FIG. 1 with exploded parts. FIGS. 3 and 4 show more details of the first preferred embodiment. FIG. 3 schematically shows part of FIG. 2 in exploded view and FIG. 4 is an enlarged view of part of FIG. 3.

The roller blind system 100 comprises a roller blind 1 provided with a roller shaft 4 through which roller shaft a central rod 6 extends and to which roller shaft a flexible sheet member or roller curtain 2 is attached in a conventional manner. The roller blind 1 is cordless and operable by handling a bottom bar 3 attached to the roller curtain 2. Two bracket connectors 21 are attached at the outer ends of the roller blind 1. The bracket connectors 21 are arranged for releasable attachment to mounting brackets 20 for mounting the roller blind system on a surface. Optionally end caps 27 are mounted over the mounting brackets 20 in the mounted state of the roller blind 1.

Suitable devices for mounting a shaft of a screen such as a window covering, on a surface, such as a wall, window frame or a ceiling, having releasably attachable mounting brackets and bracket connectors or shaft holders are known in the relevant field. Particularly suitable is a device of the same applicant that is described in the abovementioned European patent application EP2933428, incorporated herein by reference. The known mounting brackets and bracket connectors are shown in the figures and will now be briefly described. Shaft holder or bracket connector 21 is provided with a connecting piece or pin for connection to the shaft of the roller blind 1. Mounting bracket 20 is provided with one locking tooth 20-2 and bracket connector 21 is provided with a corresponding slot which is configured to receive locking tooth 20-2. Because an end plate 21-3 is arranged at a distance from bracket connector 21 using two spacers on bracket connector 21, the space between the two spacers here forms the slot. Bracket connector 21 is provided with a controllable hook arranged on a tongue 21-5 on end plate 21-3. The hook is however not visible in the perspective of this figure. Locking tooth 20-2 is provided with a hole 20-3. When locking tooth 20-2 is placed in the slot, the hook will drop into hole 20-3 and bracket connector 21 will be locked to mounting bracket 20. Bracket connector 21 can be unlocked from mounting bracket 20 again by operating the tongue 21-5.

Mounting bracket 20 is also provided with guide teeth 20-4 and 20-5 which engage on both sides of the spacers. Guide teeth 20-4 and 20-5 guide bracket connector 21 in mounting bracket 20. Locking tooth 20-2 and guide teeth 20-4 and 20-5 together form a fork.

A tension spring 5 is fixedly connected to the central rod 6 and the roller shaft 4. The tension spring 5 is merely schematically shown in the figures. The tension spring 5 is attached between a spring holder 8 and a spring winder 9. The spring holder 8 is fixedly attached to the adjustable central rod 6 whereas the spring winder 9 is coupled to the roller shaft 4. Suitable tension springs are helically wound and known in the relevant field.

The roller blind 1 further comprises a tension adjusting mechanism 10 for adjusting the tension of the tension spring 5. According to the invention the tension adjusting mechanism comprises an adjusting spring 15 and an adjusting wheel 11 having first engaging means acting on the adjusting spring 15. The tension adjusting mechanism 10 further comprises second engaging means 18 for engaging the adjusting spring 15, which second engaging means are arranged at one outer end of the central rod 6.

The adjusting spring 15 has a substantially prismatic shape, i.e. has substantially the same cross section over its entire length. The adjusting spring 15 terminates in tangs 15A. The wheel 11 has a central opening 11*a*. In accordance with the invention the adjusting wheel 11 and the adjusting spring 15 are arranged coaxially on a bush or pin 22 of the bracket connector 21. The wheel 11 is designed for manual operation and is preferable provided with a crenated edge 12.

According to the present invention the first engaging means comprise a first bush part 13 extending around the central opening 11*a* in the wheel 11. The first bush part 13 is shaped as part of a cylinder and has a diameter larger than the diameter of the adjusting spring 15 that can be partly received in the first bush part 13. The first bush part 13 is provided with outer edges 13*a* for engaging the tangs 15*a* of the adjusting spring 15.

The second engaging means comprise a second bush part 18. The second bush part 18 is shaped as part of a cylinder. The diameter of the second bush part 18 is substantially equal to the diameter of the first bush part 13. The shape of the second bush part 18 is essentially complementary to the shape of the first bush part 13. In the assembled state of the tension adjusting mechanism 10 the first and second bush parts together form a substantially cylindrical space to largely enclose the adjusting spring 15.

Figure 5:
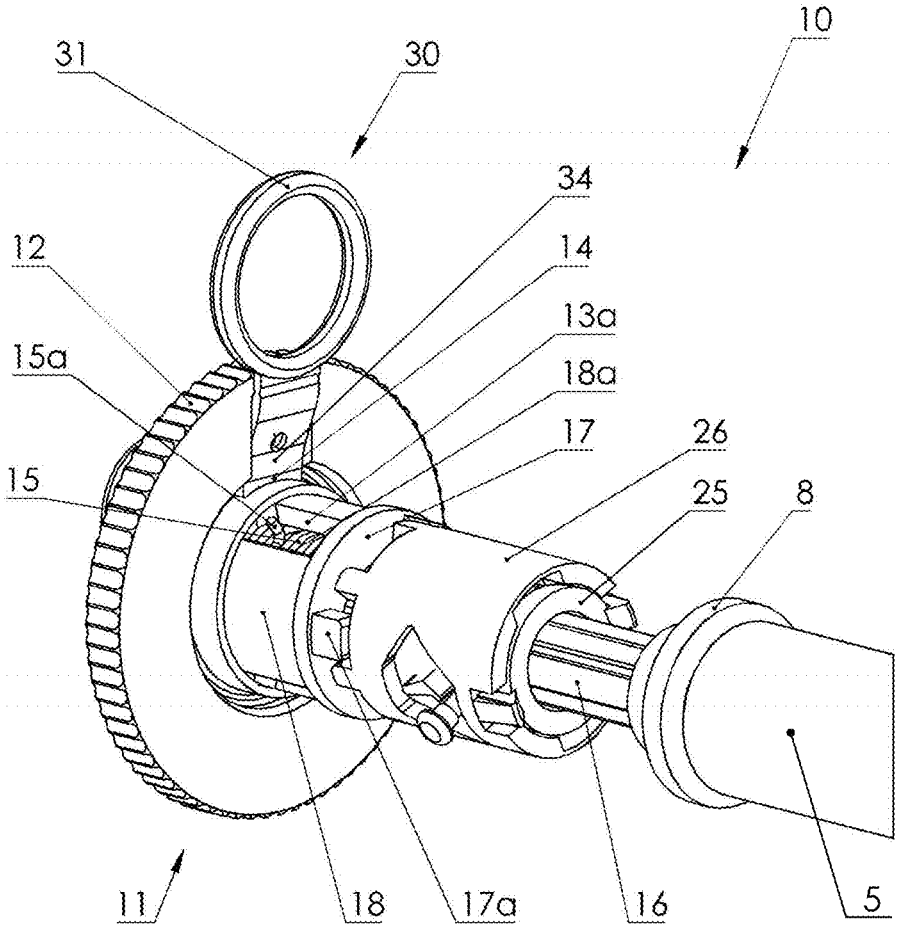
FIG. 5 shows part of FIG. 4 in more detail.

The second bush part 18 has edges 18*a* engaging on the tangs 15 of the adjusting spring from an opposite side as do the edges 13*a* of the first bush part 13. Between said edges 13*a*, 18*a* a gap is present between the first and second bush parts 13, 18 from which the tangs 15*a* freely protrude, as can be seen in FIG. 5.

The bracket connector 21 is provided with a bush or pin 22 for indirectly connecting the central rod 6 of the roller blind 1. In the preferred embodiment shown the pin 22 is provided with a central opening 23 for receiving a bush 19 present at the same outer end as the second bush part 18. Said outer end is the outer end of an adjusting rod 16 to be coupled as an extension to the central rod 6. The adjusting rod 16 is provided with a positioning flange 17 for positioning against the first bush part 13 on the wheel 11. On the flange 17 cams 17*a* are present for connecting the flange 17 to a connecting bush 26 positioned co-axially over the adjusting rod 16. A bush bearing 25 is received in the connecting bush 26 and co-axially on the adjusting rod 16. Preferable the adjusting rod 16 has an unround cross section to facilitate assembly. The connecting bush 26 serves to lock the end plug 7. Suitable alternatives for locking the end plug are available in the art.

An end plug 7 is mounted substantially over the parts of the adjusting mechanism 10 in the assembled state and is connected to the spring holder 8 in a known manner.

In the assembled state the adjusting spring 15 is enclosed in the space between the pin 22 and the first bush part 13 and the second bush part 18. The space for the adjusting spring 15 is large enough to allow to house the adjusting spring 15 in two configurations: a relaxed configuration and a tightened or strangled configuration.

The first bush part 13 engages the adjusting spring 15 from the outside pushing the adjusting spring 15 in a first relaxed or loose configuration. In the relaxed or loose configuration of the adjusting spring 15, the adjusting spring 15 touches the surface of bush or pin 22 only loosely (if at all), and therefore the wheel 11 can be manually operated to rotate the central rod 6 in a clockwise respectively counter clockwise direction to enhance respectively decrease the tension in the tension spring 5.

The second bush part 18 engages the adjusting spring 15 from the inside pushing the adjusting spring 15 in the second tightened or strangled configuration. In the tightened or strangled configuration the adjusting spring frictionally engages the outer surface of the bush or pin 22. In this configuration the bracket connector 21 and the central rod 6 are interlocked. Consequently the tension spring 5 will remain its tension as adjusted by the tension adjusting mechanism.

Roller blind 1 is additionally provided with locking means for locking the adjusting wheel 11 against rotation. In a first preferred embodiment the locking means comprise a locking element shaped as a pawl 30 having a ring 31 and a lip 34. An opening 14 is provided on the wheel 11 and a mating recess 24 is provided on the circumference of the pin 22 of the bracket connector 21. The pawl 30 can be inserted in radial direction of the roller blind. Lip 34 is then received in opening 14 and recess 24 and locks rotation of wheel 11 with respect to the bracket connector 21. Once the roller blind 1 is mounted in the mounting bracket, the pawl 30 can be easily removed by a user.

FIG. 6 shows a schematic view of a second preferred embodiment of a locking element 32 as an alternative to locking element 30. FIGS. 7A respectively 7B schematically show the locking element of FIG. 6 on a roller blind system according to the invention from a first respectively a second point of view.

When the roller blind 1 is mounted in the mounting bracket 20, the alternative locking element 32 is automatically pushed out by the mounting bracket 20. No action is required by the user.

The alternative locking element 32 is provided with the lip 34 described above to lock rotation of the bracket connector 21. In FIG. 7B it can be seen that end plug 7 is provided with a recess 7*a* to receive the lip 34.

The alternative locking element 32 is further provided with a tongue 35 to further lock the locking element 32 to the bracket connector 21.

The lip 34 and the tongue 35 are interconnected by a bridge part 37 from which they project substantially in the same direction. The bridge part 37 is generally arc shaped. Both the lip 34 and the tongue 35 project substantially in radial direction from the arc shaped bridge part 37. The tongue 35 is provided with a hole 36.

The bracket connector 21 is provided with a slot formed by the space between the two spacers 21-7 and 21-8. The hook 21-4 is arranged on the tongue 21-5 on the end plate 21-3. When the locking element 32 is placed over the adjusting wheel, the tongue 35 is received in the slot, the hook 21-4 will drop into hole 36 and the locking element 32 will be locked to bracket connector 21.

The alternative locking element 32 can be pushed out of the bracket connector 21 by different types of mounting brackets.

FIG. 7C illustrates the cooperation with the mounting bracket 20.

When the bracket connector 21 is mounted into the mounting bracket 20, the locking tooth 20-2 enters the slot from the opposite side and pushes the tongue 35 out of the slot. The locking element 32 will unlock automatically.

FIG. 8 illustrates the cooperation with another mounting bracket 40. Mounting bracket 40 has two guide teeth 40-4 and 40-5 which engage on both sides of the spacers. Guide teeth 40-4 and 40-5 guide bracket connector 21 in mounting bracket 40.

The tongue 35 is connected to the arc 37 by an extension 33 having shoulders 38 and 39. The width of the extension 33 is larger than the width of the tongue 35.

When the bracket connector 21 is mounted into the mounting bracket 40 the guide teeth 40-4 and 40-5 will push against shoulders 38 and 39 resulting in automatic unlocking of the locking element 32.

The locking element according to the invention is generally suitable for locking onto a bracket connector of a roller blind system for locking against rotation. Furthermore the locking element is arranged for cooperation with a mounting bracket for unlocking from the bracket connector.

The invention is of course not limited to the described and shown preferred embodiment but extends to any embodiment falling within the scope of protection as defined in the claims and as seen in the light of the foregoing description and accompanying drawings.

The invention claimed is:

1. A roller blind system comprising:

a roller blind provided with a roller shaft, wherein a central rod extends through the roller shaft and a flexible sheet member is attached to the roller shaft; wherein the roller blind system is further provided with two bracket connectors attached at outer ends of the roller shaft, wherein each bracket connector is provided with a pin for connection to the shaft of the roller blind, and an end plate is arranged by two spacers on the bracket connectors, wherein a space between the two spacers forms a slot and each bracket connector is provided with a controllable hook arranged on a tongue on the end plate, wherein the roller blind system is further provided with two mounting brackets for mounting the roller blind system on a surface, wherein each mounting bracket is provided with one locking tooth with a hole, wherein each of the bracket connectors is arranged for releasable coupling to one of the mounting brackets and each of the bracket connectors can be locked to one of the mounting brackets by placing the locking tooth in the slot and dropping the hook in the hole, wherein each of the bracket connectors can be unlocked from each mounting bracket by operating the tongue, wherein the roller blind is configured to be spring operated and comprises a tension spring fixedly connected to the central rod and to the roller shaft and a tension adjusting mechanism for adjusting tension of the tension spring;

the tension adjusting mechanism comprises an adjusting wheel and an adjusting spring for adjusting a rotational position of the central rod, wherein the adjusting wheel and the adjusting spring are arranged coaxially on the pin of one of the bracket connectors;

the tension adjusting mechanism further comprises first engaging means for pushing the adjusting spring in a relaxed configuration and second engaging means for pushing the adjusting spring in a tightened configuration; and wherein the first engaging means is arranged on the adjusting wheel and the second engaging means is connected to the central rod by way of an adjusting rod.

2. The roller blind system according to claim 1, wherein the first engaging means comprises a first bush part and wherein the second engaging means comprises a second bush part; and the adjusting spring is enclosed by the first bush part and the second bush part.

3. The roller blind system according to claim 1, wherein the tension adjusting mechanism further comprises the adjusting rod coupled as an extension to the central rod; and the second engaging means is arranged on the adjusting rod.

4. The roller blind system according to claim 1, wherein the adjusting wheel is arranged for manual operation.

5. The roller blind system according to claim 1, further comprising:

a locking element for locking rotation of one of the bracket connectors with respect to the central rod.

6. The roller blind system according to claim 5, wherein the locking element is arranged for engaging the adjusting wheel, said adjusting wheel having two outer flat sides, and for locking onto one of the bracket connectors on both outer flat sides of the adjusting wheel.

7. The roller blind system according to claim 5, wherein the locking element comprises a lip;

the adjusting wheel is provided with an opening for receiving the lip; and one of the bracket connectors is provided with a mating recess for receiving the lip.

8. The roller blind system according to claim 5, wherein the locking element comprises a tongue to be received in the slot provided on one of the bracket connectors.

9. The roller blind system according to claim 8, wherein the locking element comprises a pair of shoulders adjacent to the tongue of the locking element.

10. The roller blind system according to claim 5, wherein the locking element comprises a bridge part for bridging the adjusting wheel.

11. A locking element and a spring operated roller blind system, said spring operated roller blind system comprising:

a roller blind provided with a roller shaft, wherein a central rod extends through the roller shaft and a flexible sheet member is attached to the roller shaft; wherein the roller blind system is further provided with two bracket connectors attached at outer ends of the roller shaft, wherein each bracket connector is provided with a pin for connection to the shaft of the roller blind, an end plate is arranged by two spacers on the bracket connectors, wherein a space between the two spacers forms a slot and each bracket connector is provided with a controllable hook arranged on a tongue on the end plate, wherein the roller blind system is further provided with two mounting brackets for mounting the roller blind system on a surface, wherein each mounting bracket is provided with one locking tooth with a hole, wherein each of the bracket connectors is arranged for releasable coupling to one of the mounting brackets; and each of the bracket connectors can be locked to one of the mounting brackets by placing the locking tooth in the slot and dropping the hook in the hole, wherein each of the bracket connectors can be unlocked from each mounting bracket by operating the tongue, wherein the roller blind is configured to be spring operated and comprises a tension spring fixedly connected to the central rod and to the roller shaft, and a tension adjusting mechanism for adjusting tension of the tension spring; wherein the tension adjusting mechanism comprises an adjusting wheel and an adjusting spring for adjusting a rotational position of the central rod, wherein the adjusting wheel and the adjusting spring are arranged coaxially on the pin of one of the bracket connectors, the tension adjusting mechanism further comprises first engaging means for pushing the adjusting spring in a relaxed configuration and second engaging means for pushing the adjusting spring in a tightened configuration;

the first engaging means is arranged on the adjusting wheel; and the second engaging means is connected to the central rod by way of an adjusting rod; and wherein the locking element comprises a lip and a tongue interconnected by a bridge part, the locking element is arranged for bridging the adjusting wheel, said adjusting wheel having two outer flat sides, and for locking onto one of the bracket connectors on both outer flat sides of the adjusting wheel.

12. The locking element and spring operated roller blind system according to claim 11, wherein the locking element is arranged for cooperation with one of the mounting brackets for unlocking from one of the bracket connectors.

* * * * *